US005749175A

United States Patent [19]

Koike et al.

[11] Patent Number: 5,749,175

[45] Date of Patent: May 12, 1998

[54] STRUCTURE OF MATING PORTIONS OF DOUBLE DOOR ASSEMBLY

[75] Inventors: Sou Koike; Masao Hirano, both of Toyama-ken, Japan

[73] Assignee: YKK Architectural Products Inc., Tokyo, Japan

[21] Appl. No.: 790,368

[22] Filed: Jan. 28, 1997

[30] Foreign Application Priority Data

Feb. 1, 1996 [JP] Japan ..... 8-016440

[51] Int. Cl.[6] ..... E06B 7/16

[52] U.S. Cl. ..... 49/368; 49/366

[58] Field of Search ..... 49/366, 367, 368

[56] References Cited

U.S. PATENT DOCUMENTS

| | | | |
|---|---|---|---|
| 2,930,086 | 3/1960 | Griffiths | 49/366 |
| 3,070,852 | 1/1963 | Hilliker | 49/366 |
| 3,161,925 | 12/1964 | Bertolini | 49/368 |
| 3,827,183 | 8/1974 | Zimmerman et al. | 49/366 X |
| 3,959,927 | 6/1976 | Good . | |
| 4,015,368 | 4/1977 | Court et al. | 49/368 X |
| 4,194,776 | 3/1980 | Biebuyck . | |
| 4,204,369 | 5/1980 | Hubbard . | |
| 4,283,882 | 8/1981 | Hubbard et al. | 49/366 X |
| 4,320,161 | 3/1982 | Redman . | |
| 4,370,827 | 2/1983 | Furuminato . | |
| 4,428,153 | 1/1984 | Klinger et al. . | |
| 4,488,378 | 12/1984 | Symon . | |

*Primary Examiner*—Jerry Redman

*Attorney, Agent, or Firm*—Finnegan, Henderson, Farabow, Garrett & Dunner, L.L.P.

[57] ABSTRACT

In a double door assembly in which first and second doors are respectively mounted to bilateral vertical frame members of a door frame in the manner that each door can swing both to the indoor side and to the outdoor side for its opening and closing, a structure of mating portions of the doors comprises a first mating frame element constituting the first door and providing a first mating surface, a second mating frame element constituting the second door and providing a second mating surface, a first mating seal member attached to the first mating surface to project toward the second mating surface and a second mating seal member attached to the second mating surface to the indoor side relative to the first mating seal member to project toward the first mating surface. The first mating seal member is adapted to contact the second mating surface when the first and second doors are closed while the second mating seal member is adapted to be apart from the first mating surface when the first and second doors are closed.

13 Claims, 6 Drawing Sheets

STRUCTURE OF MATING PORTIONS OF DOUBLE DOOR ASSEMBLY

BACKGROUND OF THE INVENTION

The present invention relates to a structure of mating portions of a double door assembly in which two doors are mounted to a door frame in the manner that each door can swing both to the indoor side and to the outdoor side for its opening and closing.

There is known a double door assembly in which two doors are respectively connected to bilateral vertical frame members of a door frame by means of hinges so that each door can swing both to the indoor side and to the outdoor side for its opening and closing.

In this kind of double door assembly, such structure is known that mating seal members made of a soft mohair material are respectively attached to the mating frame elements of both of the doors in the manner that when the two doors are closed, the front edge portions of the respective mating seal members contact with each other, thereby to stop a gap between the mating portions and prevent water, air, dust, light or the like (hereunder briefly referred to as "water or the like") from penetrating through the mating portions.

In another known structure in the above described kind of double door assembly, a water and air seal member (hereunder briefly referred to as "seal member") made of rubber or the like is attached to the mating frame element of one of the doors while a projection piece is formed to the mating frame element of the other door, so that the seal member is clamped by the projection piece and the opposite mating frame element when the two doors are closed, thereby to stop a gap between the mating portions and keep the sealing performance at the mating portions.

In a further known structure in the above kind of double door assembly, a fin-shaped gap stopping member made of rubber or the like is attached to the mating frame element of one of the doors so that the fin-shaped gap stopping member contacts the mating frame element of the other door when the two doors are closed, thereby to stop a gap between the mating portions and keep the sealing performance at the mating portions.

In the above kind of double door assembly, after the two doors are mounted to the door frame, attitude of each door is minutely adjusted in vertical and transverse directions so as to set a gap between the mating portions (a gap between the mating frame elements of the two doors) to a predetermined value. However, it happens that the gap between the mating portions is made larger or smaller than the predetermined value owing to an inexact adjustment.

In the structure having mating seal members respectively attached to the mating frame elements of both of the doors thereby to stop water or the like from penetrating through the mating portions, if the gap between the mating portions is made larger than the predetermined value, a gap is generated between the front edge portions of both mating seal members, which considerably deteriorates the sealing performance. On the other hand, if the gap between the mating portions is made smaller than the predetermined value, the front edge portions of the mating seal members strongly abut against each other and the resistance at the time of opening and closing the doors increases, so that larger force is required for opening and closing the doors.

In the structure having a seal member attached to the mating frame element of one of the doors and a projection piece formed to the mating frame element of the other door thereby to keep the sealing performance at the mating portions, the doors need to be opened in such manner that after the door having the projection piece is made to swing to the indoor side to open, then the door having the seal member is made to swing to the indoor side to open, or that after the door having the seal member is made to swing to the outdoor side to open, then the door having the projection piece is made to swing to the outdoor side to open. That is, the two doors can not be freely made to swing to the indoor side and to the outdoor side for their opening and closing. This reduces the convenience of the double door assembly.

In the structure having a fin-shaped gap stopping member attached to the mating frame element of one of the doors thereby to keep the sealing performance at the mating portions, when a large wind pressure is applied to the fin-shaped gap stopping member, the fin-shaped gap stopping member is deformed and falls apart from the mating frame element of the other door, which lowers the sealing performance.

SUMMARY OF THE INVENTION

An object of the present invention is to provide a structure of mating portions of a double door assembly which substantially eliminates defects or drawbacks encountered in the above described prior art.

This and other objects can be achieved according to one aspect of the present invention by a structure of mating portions of a double door assembly in which first and second doors are respectively mounted to bilateral vertical frame members of a door frame in the manner that each door can swing both to the indoor side and to the outdoor side for its opening and closing, the structure comprising:

- a first mating frame element constituting the first door and providing a first mating surface;
- a second mating frame element constituting the second door and providing a second mating surface;
- a first mating seal member attached to the first mating surface to project toward the second mating surface; and
- a second mating seal member attached to the second mating surface to the indoor side relative to the first mating seal member to project toward the first mating surface,
- wherein the first mating seal member is adapted to contact the second mating surface when the first and second doors are closed while the second mating seal member is adapted to be apart from the first mating surface when the first and second doors are closed.

In this structure, even when a gap between the mating portions is made larger than a predetermined value owing to an inexact adjustment of the door attitude, the mating seal members still overlap each other. Therefore, required sealing performance can be maintained at the mating portions.

On the other hand, even when the gap between the mating portions is made smaller than the predetermined value owing to an inexact adjustment of the door attitude, since the structure is so provided that the first mating seal member can be flexibly deformed by the second mating seal member with small force when the doors are made to swing for opening and closing, the resistance at the time of opening and closing the doors is held at a lower level.

According to another aspect of the present invention, there is provided a structure of mating portions of a double door assembly in which first and second doors are respectively mounted to bilateral vertical frame members of a door frame in the manner that each door can swing both to the indoor side and to the outdoor side for its opening and closing, the structure comprising:

a first mating frame element constituting the first door and providing a first mating surface;

a second mating frame element constituting the second door and providing a second mating surface; and a fin-shaped seal member attached to the first mating surface to project toward the second mating surface, the fin-shaped seal member being so adapted that the front end portion of the fin-shaped seal member is in pressure contact with the second mating surface when the first and second doors are closed, wherein the first mating surface comprises a portion retracted inwardly to the center of the first door and a portion protruded outwardly from the center of the first door, the second mating surface comprises a portion retracted inwardly to the center of the second door and a portion protruded outwardly from the center of the second door, and the fin-shaped seal member is attached to the inwardly retracted portion of the first mating surface and contacts the inwardly retracted portion of the second mating surface when the first and second doors are closed.

In this structure, the fin-shaped seal member attached to the first mating surface is so provided as to be in pressure contact with the second mating surface when the doors are closed, and at the same time the fin-shaped seal member is protected from being extremely deformed when it passes over the most outwardly protruded portion of the second mating surface at the time of opening and closing the doors.

According to a further aspect of the present invention, there is provided a structure of mating portions of a double door assembly in which first and second doors are respectively mounted to bilateral vertical frame members of a door frame in the manner that each door can swing both to the indoor side and to the outdoor side for its opening and closing, the structure comprising:

a first mating frame element constituting the first door and providing a first mating surface;

a second mating frame element constituting the second door and providing a second mating surface;

a fin-shaped seal member attached to the first mating surface to project toward the second mating surface, the fin-shaped seal member being so adapted that the front end portion of the fin-shaped seal member is in pressure contact with the indoor side surface of the second mating element when the first and second doors are closed; and an attachment attached to the first mating frame element to support the indoor side surface of the fin-shaped seal member.

In this structure, the fin-shaped seal member attached to the first mating surface is so provided as to be in pressure contact with the indoor side surface of the second mating element when the doors are closed, and at the same time the fin-shaped seal member is protected by the attachment from being bent or deformed toward the indoor side owing to a wind pressure.

The nature and further features of the present invention will be made clearer from the following descriptions made with reference to the accompanying drawings.

DESCRIPTION OF THE PREFERRED EMBODIMENTS

The preferred embodiments of the present invention will be described hereunder with reference to the accompanying drawings.

Figure 1:
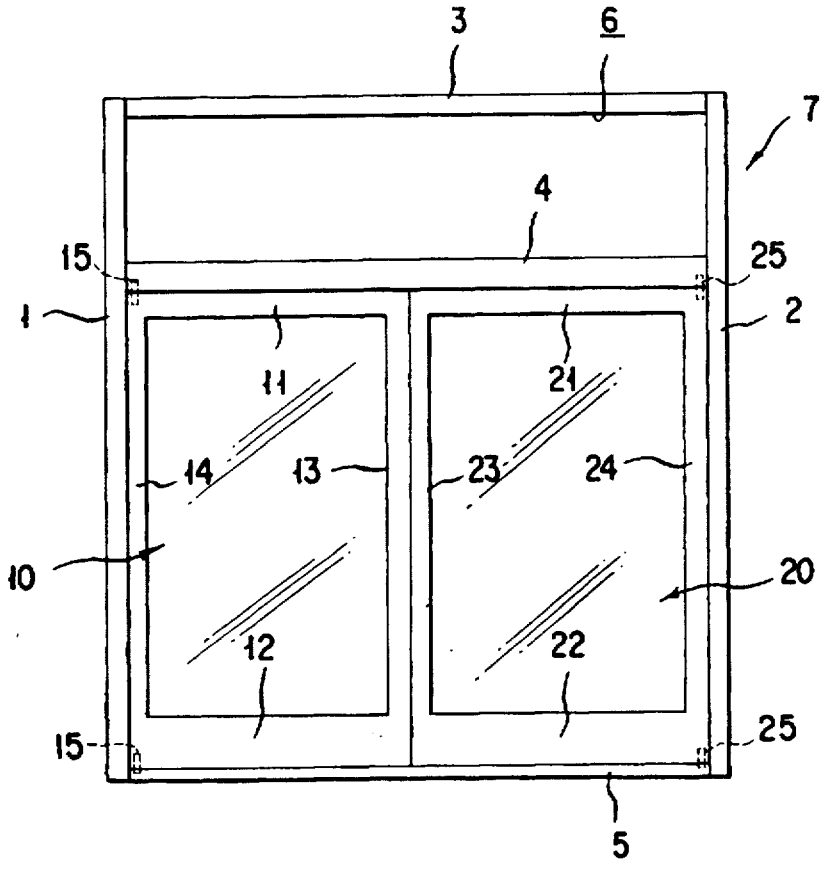
FIG. 1 is a schematic front view of a double door assembly.

FIG. 1 shows a double door assembly to which the present invention is applicable. A door frame 7 is composed of bilateral vertical frame members 1 and 2, an upper transverse frame member 3, an intermediate transverse frame member 4 and a lower transverse frame member 5 so as to have a transom portion 6. A door 10 comprises an upper frame element 11, a lower frame element 12, a mating frame element 13 and a vertical frame element 14, and is so installed as to be able to swing both to the indoor side and to the outdoor side by connecting the vertical frame element 14 to the vertical frame member 1 of the door frame 7 by means of hinges 15. The other door 20 comprises an upper frame element 21, a lower frame element 22, a mating frame element 23 and a vertical frame element 24, and is so installed as to be able to swing both to the indoor side and to the outdoor side by connecting the vertical frame element 24 to the other vertical frame member 2 of the door frame 7 by means of hinges 25.

Figure 2:
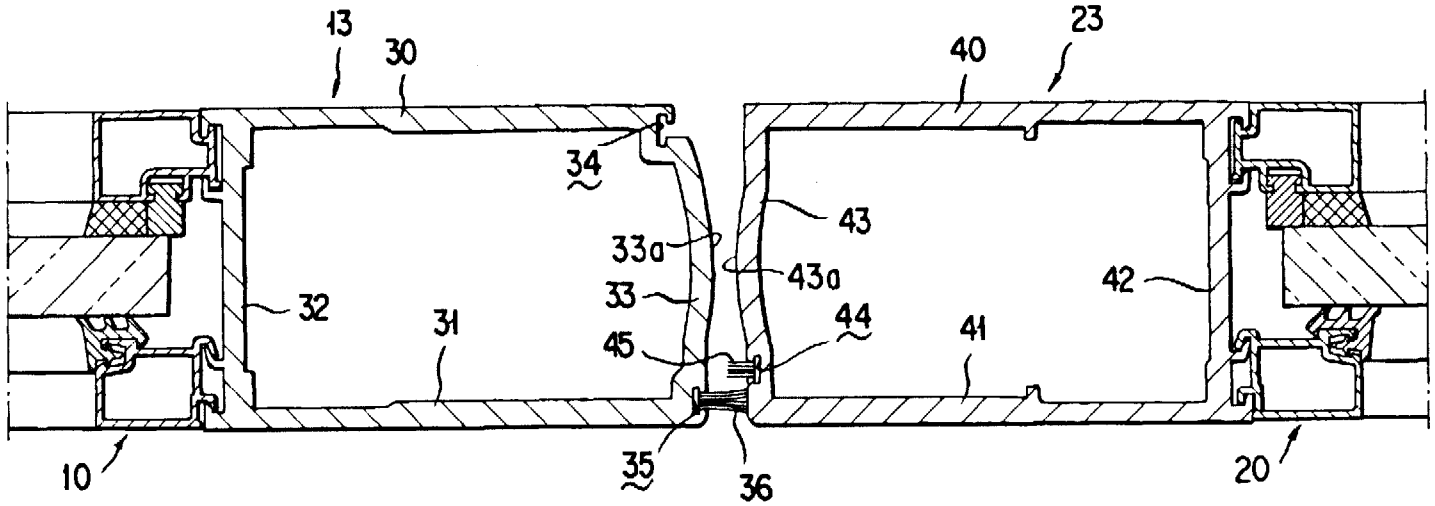
FIG. 2 is a transverse sectional view of mating portions of the double door assembly according to a first embodiment of the present invention.

FIG. 2 shows a first embodiment of the present invention. The mating frame element 13 of the door 10 is an elongated member of a hollow rectangular cross section comprising an indoor side plate 30, an outdoor side plate 31, an inner side plate 32 and an outer side plate 33. (Here and hereunder, the words "inner", "inwardly", "outer" and "outwardly" shall be used relative to the door 10 or the door 20. The words "inner" or "inwardly" shall indicate the side nearer to the center of the door in question, while the "outer" or "outwardly" shall indicate the side farther from the center of the door in question.) The outer side plate 33 which provides a mating surface is curved in an arcuate shape with its intermediate portion **33*a*** protruding most outwardly and its indoor side and outdoor side portions retracted inwardly.

The outer side plate 33 is provided with an indoor side recessed groove 34 and an outdoor side recessed groove 35 respectively formed at its indoor side and outdoor side portions, and a mating seal member 36 made of a soft mohair material is fitted in the outdoor side recessed groove 35.

The mating frame element 23 of the other door 20 is an elongated member of a hollow rectangular cross section comprising an indoor side plate 40, an outdoor side plate 41, an inner side plate 42 and an outer side plate 43. The outer side plate 43 which provides a mating surface is curved in an arcuate shape with its intermediate portion **43*a*** protruding most outwardly and its indoor side and outdoor side portions retracted inwardly.

The outer side plate 43 is provided with an outdoor side recessed groove 44 formed at its outdoor side portion, and a mating seal member 45 made of a soft mohair material is fitted in the outdoor side recessed groove 45.

The mating seal member 36 attached to the mating frame element 13 has such projection length that it contacts the outer side plate 43 of the other mating frame element 23. The other mating seal member 45 attached to the mating frame element 23 has about half the projection length of the mating seal member 36 and is apart from the outer side plate 33 of the mating frame element 13. The mating seal member 45 is positioned to the indoor side relative to the mating seal member 36.

In this structure, even when a gap between the mating portions (a gap between the mating frame element 13 of the door 10 and the mating frame element 23 of the other door 20) is made larger than a predetermined value by a value corresponding to the projection length of the mating seal member 45 owing to an inexact adjustment of the attitude of the door 10 and/or 20, the mating seal member 36 still overlaps the other mating seal member 45. Therefore, lowering of the sealing performance is restrained, and required sealing performance is maintained at the mating portions. In addition, the indoor side is protected from exposure to sight from the outdoor side, and light leakage through the mating portions is prevented.

On the other hand, when the gap between the mating portions is made smaller than a predetermined value owing to an inexact adjustment of the attitude of the door 10 and/or 20, the mating seal members 36 and 45 interfere with each other for a relatively long distance when the door 10 is made to swing to the indoor side to open or when the door 20 is made to swing to the outdoor side to open. However, in the structure described above, since the mating seal member 36 of longer projection length can be flexibly deformed by the mating seal member 45 of shorter projection length with small force, the resistance at the time of opening and closing the doors 10 and 20 is held at a lower level, so that the doors 10 and 20 can be smoothly opened and closed with small force.

Figure 3:
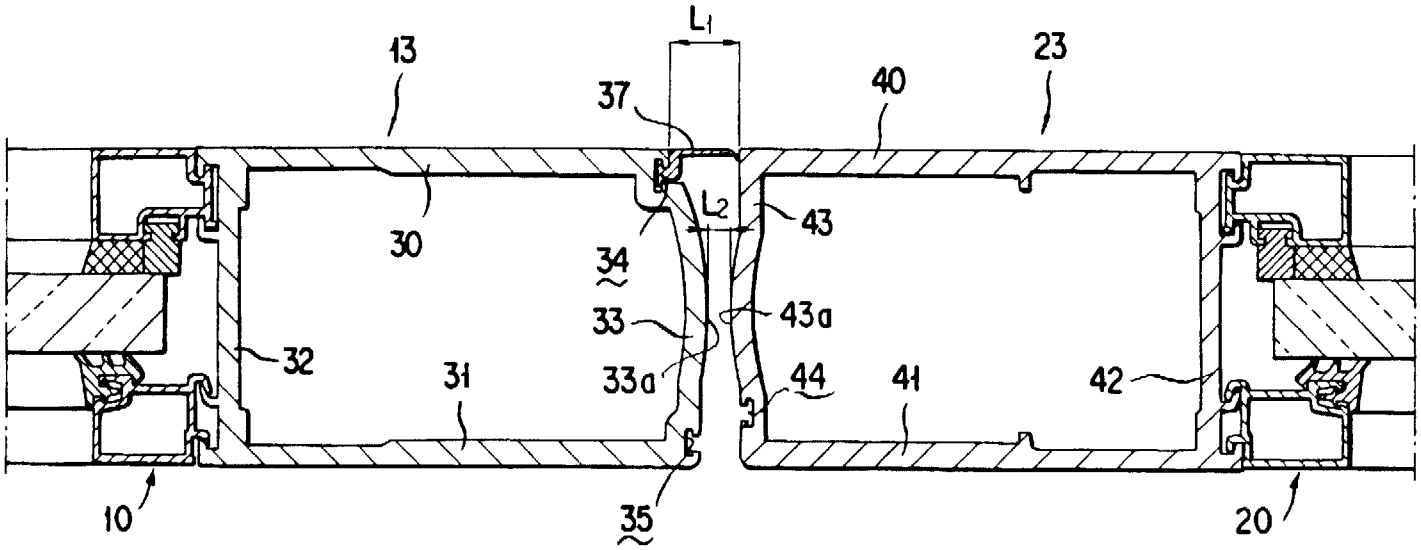
FIG. 3 is a transverse sectional view of mating portions of the double door assembly according to a second embodiment of the present invention.

FIG. 3 shows a second embodiment of the present invention. The mating frame element 13 and 23 of the respective doors 10 and 20 themselves have substantively the same structures as those of the first embodiment, while a fin-shaped seal member 37 made of an elastic material such as rubber is fitted in the indoor side recessed groove 34 of the mating frame element 13 of the door 10.

The fin-shaped seal member 37 is so adapted that the front end portion of the fin-shaped seal member 37 is in pressure contact with the outer side plate 43 of the other mating frame element 23 when the doors are closed, thereby to keep the sealing performance at the mating portions.

In this embodiment, the fin-shaped seal member 37 is attached to the outer side plate 33 at its portion retracted inwardly as compared with its most outwardly protruded portion 33*a*, and the projection length $L_1$ of the fin-shaped seal member 37 (the distance between the portion of the outer side plate 33 to which the fin-shaped seal member 37 is attached and the portion of the outer side plate 43 with which the fin-shaped seal member 37 is in pressure contact) is about three times the smallest distance $L_2$ between the mating portions.

In this structure, the doors 10 and 20 are allowed to swing freely both to the indoor side and to the outdoor side for their opening and closing.

Figure 4:
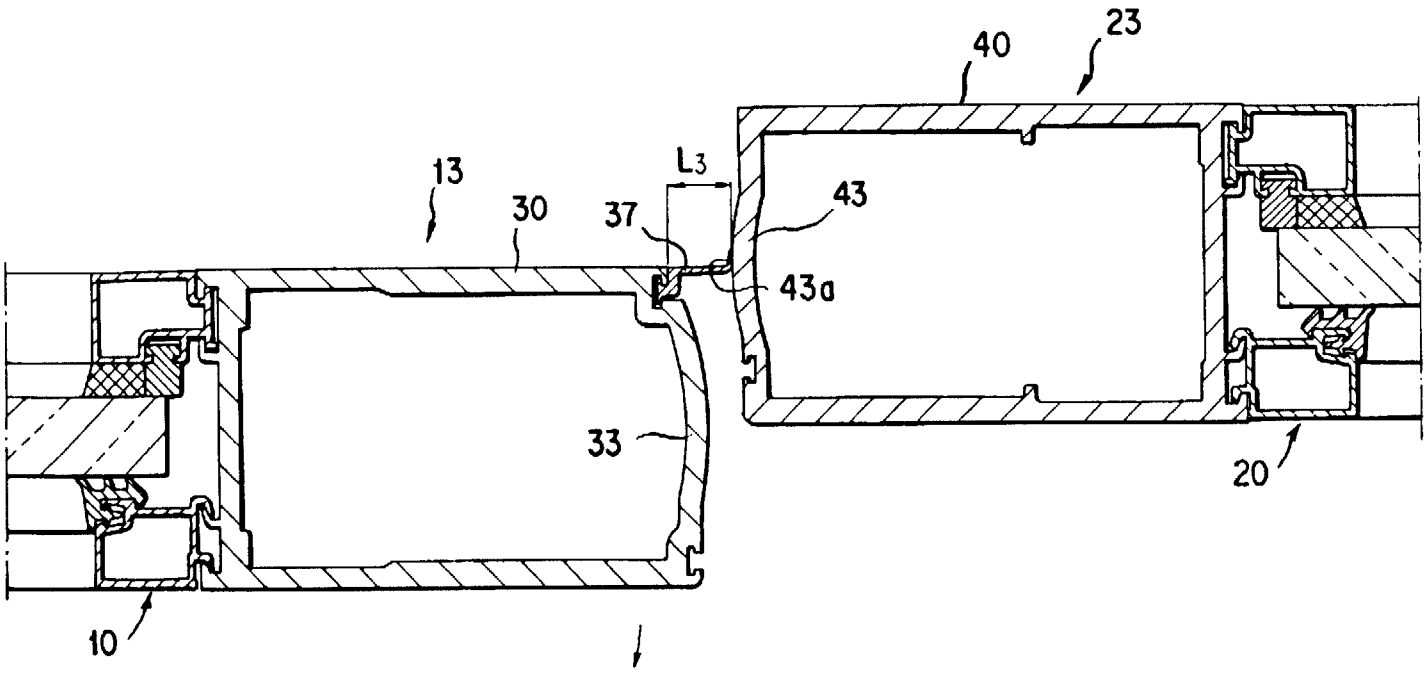
FIG. 4 is a transverse sectional view showing the mating portions of the double door assembly when one of the doors is opened.

As shown in FIG. 4, when the door 10 is made to swing to the outdoor side, the fin-shaped seal member 37 contacts the outer side plate 43 of the other mating frame element 23 and is deformed thereby. However, at this time, the distance $L_3$ between the portion of the outer side plate 33 of the mating frame element 13 to which the fin-shaped seal member 37 is attached and the most outwardly protruded portion 43*a* of the outer side plate 43 of the other mating frame element 23 is larger than the above mentioned smallest distance $L_2$ between the mating portions, and therefore the fin-shaped seal member 37 is protected from being extremely deformed.

The resistance caused by deformation of the fin-shaped seal member 37 when the door 10 is made to swing to the outdoor side to open is accordingly held at a lower level, and therefore the doors 10 and 20 can be opened and closed smoothly with small force and the fin-shaped seal member 37 is not worn in short period of time.

In general, the doors 10 and 20 are so provided as to be locked between the outer side plates 33 and 43 of the mating frame elements 13 and 23 by means of a hook-shaped lock bolt, a latch-shaped lock bolt or the like. Therefore, the distance between the outer side plates 33 and 43 (the smallest distance $L_2$ between the mating portions) needs to be sufficiently small for the lock bolt to extend over, for example, 6 mm. In a structure where the fin-shaped seal member must pass through such smallest distance $L_2$ when the door is made to swing for opening and closing, the fin-shaped seal member is extremely deformed, resistance at the time of opening and closing the doors is accordingly large, and therefore the fin-shaped seal member is worn in short period of time.

Figure 5:
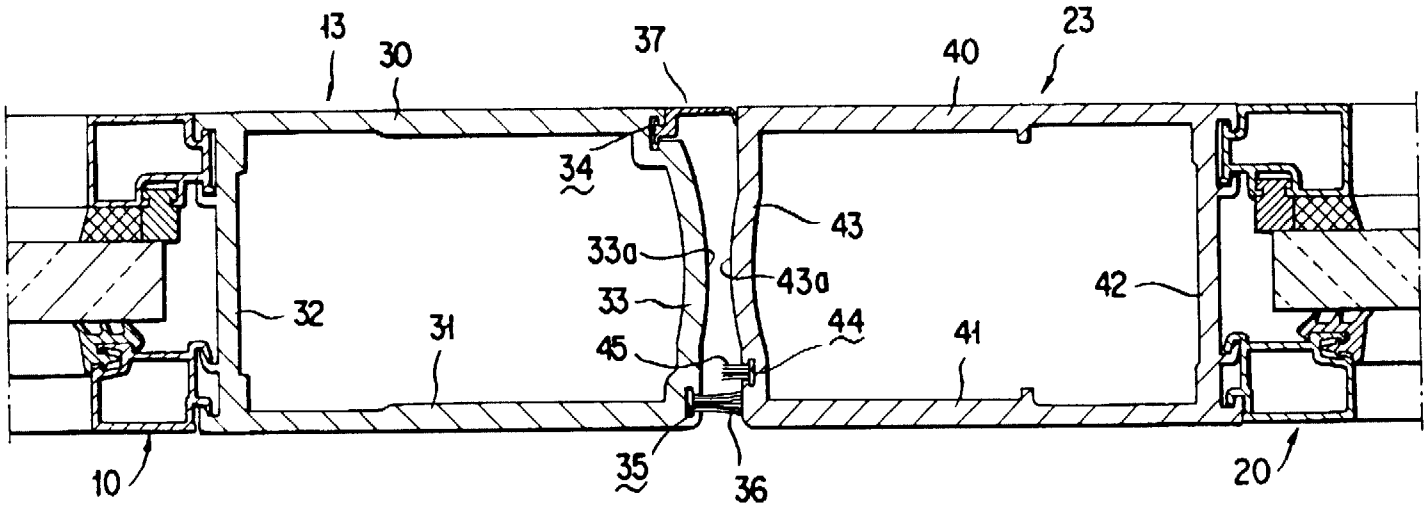
FIG. 5 is a transverse sectional view of mating portions of the double door assembly according to a third embodiment of the present invention.

FIG. 5 shows a third embodiment of the present invention, where the mating frame element 13 of the door 10 is provided with both the mating seal member 36 and the fin-shaped seal member 37 while the mating frame element 23 of the other door 20 is provided with the mating seal member 45.

In this structure, the sealing performance at the mating portions are enhanced, while the doors 10 and 20 are allowed to swing freely both to the indoor side and to the outdoor side and force required for their opening and closing is small.

Figure 6:
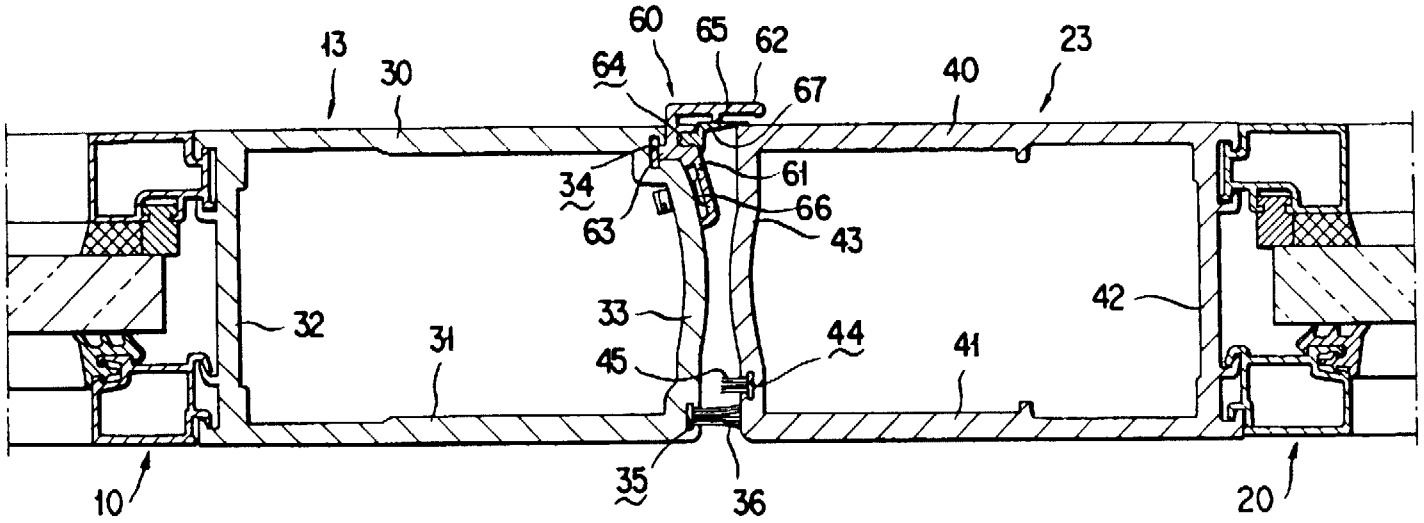
FIG. 6 is a transverse sectional view of mating portions of the double door assembly according to a fourth embodiment of the present invention.

FIG. 6 shows a fourth embodiment of the present invention. The mating frame elements 13 and 23 of the doors 10 and 20 themselves have substantially the same structures as those of the first embodiment, while an attachment 60 is attached to the outer side plate 33 of the mating frame element 13 of the door 10 at its indoor side portion.

The attachment 60 is of substantively hook-shaped cross section comprising an attachment piece 61 and a projecting piece 62. A projection piece 63 adapted to be engaged in the indoor side recessed groove 34 of the outer plate 33 is integrally formed to the attachment piece 61, and a seal member fitting groove 64 is formed at the attachment piece 61 at a position nearer to the projecting piece 62. A press projection piece 65 is integrally formed to the projecting piece 62 at its intermediate portion to project toward the outdoor side.

The attachment 60 is attached to the outer side plate 33 of the mating frame element 13 by engaging the projection piece 63 in the indoor side recessed groove 34 and securing the attachment piece 61 to the outer side plate 33 by means of a screw 66. A fin-shaped seal member 67 made of an elastic material such as rubber is fitted in the seal member fitting groove 64 of the attachment 60. It is so provided that the front end portion of the fin-shaped seal member 67 is in pressure contact with the indoor side plate 43 (the indoor side surface) of the mating frame element 23 of the other door 20 and the press projection piece 65 is in pressure contact with the indoor side surface of the fin-shaped seal member 67 at its intermediate portion when the doors 10 and 20 are closed.

In this structure, the sealing performance by the fin-shaped seal member 67 at the mating portions is made securer. The press projection piece 65 prevents the fin-shaped seal member 67 from being bent or deformed toward the indoor side owing to a wind pressure, thereby to keep the sealing performance.

Further, this structure provides a good appearance since the fin-shaped seal member 67 is covered by the projection piece 62 of the attachment 60 and is not seen from the indoor side. Furthermore, owing to the provision of the projection piece 63 adapted to be engaged in the indoor side recessed groove 34, the attachment 60 is easily positioned and firmly fitted in place.

What is claimed is:

1. A structure of mating portions of a double door assembly in which first and second doors, each having a center, an indoor side, and an outdoor side, are respectively mounted to bilateral vertical frame members of a door frame so that each door can swing both inwardly and outwardly, the structure comprising:

a first mating frame element constituting said first door and providing a first mating surface;

a second mating frame element constituting said second door and providing a second mating surface; and a fin-shaped seal member having a front end portion and being attached to said first mating surface to project toward said second mating surface, said fin-shaped seal member being so adapted that the front end portion of said fin-shaped seal member is in pressure contact with said second mating surface when the first and second doors are closed, wherein said first mating surface comprises a portion having an indoor side and being retracted inwardly to the center of said first door and a portion protruded outwardly from the center of said first door, said second mating surface comprises a portion retracted inwardly to the center of said second door and a portion protruded outwardly from the center of said second door, and said fin-shaped seal member is attached to said inwardly retracted portion of said first mating surface and contacts said inwardly retracted portion of said second mating surface when the first and second doors are closed.

2. A structure according to claim 1, wherein said first mating surface is curved in an arcuate shape with its intermediate portion protruding outwardly from the center of said first door and its indoor side and outdoor side portions retracted inwardly to the center of said first door, and said second mating surface is curved in an arcuate shape with its intermediate portion protruding outwardly from the center of said second door and its indoor side and outdoor side portions retracted inwardly to the center of said second door.

3. A structure according to claim 2, wherein said fin-shaped seal member is attached to said indoor side inwardly retracted portion of said first mating surface.

4. A structure according to claim 2, wherein said first mating surface is provided with a recessed groove at said indoor side inwardly retracted portion, and said fin-shaped seal member is fitted in said recessed groove.

5. A structure according to claim 2, wherein said fin-shaped seal member has a projection length substantively three times a distance between said outwardly protruded intermediate portions of said first and second mating surfaces.

6. A structure according to claim 1, wherein said fin-shaped seal member is made of an elastic material.

7. A structure according to claim 6, wherein said fin-shaped seal member is made of rubber.

8. A structure according to claim 1, wherein said structure further comprises a first mating seal member attached to said first mating surface to project toward said second mating surface and a second mating seal member attached to said second mating surface to the indoor side relative to said first mating seal member to project toward said first mating surface, and said first mating seal member is adapted to contact said second mating surface when the first and second doors are closed while said second mating seal member is adapted to be apart from said first mating surface when the first and second doors are closed.

9. A structure of mating portions of a double door assembly in which first and second doors, each having a center, an indoor side, and an outdoor side, are respectively mounted to bilateral vertical frame members of a door frame so that each door can swing both inwardly and outwardly, said structure comprising:

a first mating frame element constituting said first door and providing a first mating surface;

a second mating frame element constituting said second door and providing a second mating surface;

a first mating seal member attached to said first mating surface to project toward said second mating surface; and a second mating seal member attached to said second mating surface to the indoor side relative to said first mating seal member to project toward said first mating surface, wherein said first mating seal member is adapted to contact said second mating surface when the first and second doors are closed while said second mating seal member is adapted to be apart from said first mating surface when the first and second doors are closed, said first mating surface is curved in an arcuate shape with its intermediate portion protruding outwardly from a center of said first door and its indoor side and outdoor side portions retracted inwardly to the center of said first door, and said second mating surface is curved in an arcuate shape with its intermediate portion protruding outwardly from the center of said second door and its indoor side and outdoor side portions retracted inwardly to the center of said second door.

10. A structure according to claim 9, wherein said first and second mating seal members are made of a soft mohair material.

11. A structure according to claim 9, wherein said first and second mating seal members each have a first and second projection length, respectively, the second projection length being substantively half the length of the first projection length.

12. A structure of mating portions of a double door assembly in which first and second doors, each having a center and an indoor side, are respectively mounted to bilateral vertical frame members of a door frame in a manner that each door can swing both inwardly and outwardly, the structure comprising:

a first mating frame element constituting said first door and providing a first mating surface;

a second mating frame element constituting said second door and providing a second mating surface;

a fin-shaped seal member having a front end portion and being attached to said first mating surface to project toward said second mating surface, said fin-shaped seal member being so adapted that the front end portion of said fin-shaped seal member is in pressure contact with the indoor side surface of said second mating element when said first and second doors are closed; and an attachment attached to said first mating frame element to support the indoor side of said fin-shaped seal member, said structure further comprises a first mating seal member attached to said first mating surface to project toward said second mating surface and a second mating seal member attached to said second mating surface to the indoor side relative to said first mating seal member to project toward said first mating surface, and said first mating seal member is adapted to contact said second mating surface when the first and second doors are closed while said second mating seal member is adapted to be a part from said first mating surface when the first and second doors are closed.

13. A structure according to claim 12, wherein said attachment further comprises an intermediate portion and a press projection piece formed integrally to said attachment at the intermediate portion projecting away from the indoor side, and said press projection being adapted to be in pressure contact with the indoor side surface of said fin-shaped seal member when said first and second doors are closed, said attachment is of substantively hook-shaped cross section comprising an attachment piece and a projecting piece, and said attachment piece is provided with a projection piece adapted to be engaged in a recessed groove formed on the indoor side of said first mating surface, and with a recessed groove in which said fin-shaped seal member is fitted.

* * * * *